US008153204B2

(12) United States Patent
Kulkarni

(10) Patent No.: US 8,153,204 B2
(45) Date of Patent: Apr. 10, 2012

(54) IMPARTING FUNCTIONAL CHARACTERISTICS TO ENGINE PORTIONS

(75) Inventor: Anand A. Kulkarni, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1112 days.

(21) Appl. No.: 12/019,948

(22) Filed: Jan. 25, 2008

(65) Prior Publication Data

US 2009/0075057 A1 Mar. 19, 2009

Related U.S. Application Data

(60) Provisional application No. 60/973,563, filed on Sep. 19, 2007, provisional application No. 60/973,554, filed on Sep. 19, 2007.

(51) Int. Cl.
*B05D 1/36* (2006.01)

(52) U.S. Cl. ..... 427/454; 427/202; 427/426

(58) Field of Classification Search ..... 427/202, 427/426, 454

See application file for complete search history.

(56) References Cited

U.S. PATENT DOCUMENTS

| | | | | |
|---|---|---|---|---|
| 2,786,779 | A * | 3/1957 | Long et al. | 427/455 |
| 3,758,233 | A | 9/1973 | Cross et al. | |
| 5,780,171 | A | 7/1998 | Nissley et al. | |
| 6,447,848 | B1 | 9/2002 | Chow et al. | |
| 6,620,525 | B1 * | 9/2003 | Rigney et al. | 428/633 |
| 6,716,539 | B2 * | 4/2004 | Subramanian | 428/621 |
| 2001/0055652 | A1 * | 12/2001 | Dalzell et al. | 427/447 |
| 2007/0082131 | A1 | 4/2007 | Doesburg et al. | |
| 2009/0074961 | A1 | 3/2009 | Kulkarni | |

FOREIGN PATENT DOCUMENTS

| | | | |
|---|---|---|---|
| EP | 1580293 | A2 | 9/2005 |
| EP | 1772441 | A1 | 4/2007 |
| EP | 1801256 | A1 | 6/2007 |
| EP | 1 772 441 | * | 11/2007 |

OTHER PUBLICATIONS

Gwendolyn Blackwell; Final Office Action in U.S. Appl. No. 12/019,931; Apr. 28, 2010; U.S. Patent and Trademark Office; Alexandria VA.

Gwendolyn Blackwell; Office Action in U.S. Appl. No. 12/019,931; Oct. 16, 2009; U.S. Patent and Trademark Office; Alexandria VA.

Zhihai Han, Bingshi Zu, Jaijun Wng, Shikui Zhou, "A comparison of thermal shock behavior between currently plasma spray and supersonic plasma spray CeO2-Y2O3-ZrO2"graded thermal barrier coatings; Surface & Coatings Technology; vol. 201; No. 9-11; 2007; pp. 5253-5256.

K.R.Cross, W.R. Lull, R.L. Newman and J.R. Cavanagh, "Potential of Graded Coatings in Vibration Damping"; Engineering Notes; Nov. 1973; pp. 689-691; vol. 10, No. 11; Detroit Diesel Allison Division, General Motors Corporation, Indianapolis, Indiana, USA.

A. Kulkarni, J. Gutleber, S. Sampath, A. Goland, W.B. Lindquist, H. Herman, J.J. Allen, B. Dowd; "Studies of the Microstructure and Properties of Dense Ceramic Coatings produced by High-Velocity Oxygen-Fuel Combustion Spraying"; Materials Science & Engineering; Oct. 2003; pp. 124-137; Elsevier B.V., USA.

A. Kulkarni, Z. Wang, T. Nakamura, S. Sampath, A. Goland, H. Herman, J. Allen, J. Ilavsky, G. Long, J. Frahm, R.W. Steinbrech; "Comprehensive microstructural characterization and predictive property modeling of plasma-sprayed zirconia coatings"; Mar. 2003; pp. 2457-2475; Acta Materialia Inc.; Elsevier Science Ltd., USA.

Anand Kulkarni, A. Vaidya, A. Goland, S. Sampath, H. Herman; "Processing effects on porosity-property correlations in plasma sprayed yttria-stabilized zirconia coatings"; Materials and Engineering A359; Apr. 2003; 11 Pages; USA.

Anand A. Kulkarni, "On the Porosity-Property Correlations in Thermo-Structural Coatings"; Towards an Integrated Approach; State University of New York at Stony Brook; Dec. 2002; 200 Pages; USA.

* cited by examiner

*Primary Examiner* — Frederick Parker

(57) ABSTRACT

A method of imparting one or more of a variety of functional characteristic to a portion of an engine (e.g., a turbine or diesel engine) by depositing particles from different particle feedstocks so as to form a high temperature resistant coating on a surface of the engine portion, where the particle feedstocks are varied in-situ while the particle are being deposited and at least one functional characteristic corresponds to, or results from, using different particle feedstocks.

20 Claims, 2 Drawing Sheets

IMPARTING FUNCTIONAL CHARACTERISTICS TO ENGINE PORTIONS

CROSS REFERENCE TO RELATED APPLICATIONS

This application claims priority from U.S. Provisional Application Ser. Nos. 60/973,563 and 60/973,554, each of which were filed on Sep. 19, 2007, the disclosures of which are incorporated by reference in their entirety herein.

FIELD OF THE INVENTION

The present invention relates to a method of imparting at least one functional characteristic to one or more components or portions of an engine (e.g., ring segments, transition ducts, combustors, blades, vanes and shrouds of a turbine engine or portions thereof, in particular, to such a method that includes depositing particles from different particle feedstocks so as to form a high temperature resistant coating that imparts at least one functional characteristic to the portion of the engine and, more particularly, to such a method where the particle feedstocks are varied while the particles are being deposited. The present invention also relates to such coated engine components or portions resulting therefrom.

BACKGROUND OF THE INVENTION

High temperature resistant coatings have been used to protect (e.g., thermal, oxidation and hot corrosion protection) high temperature components in gas turbines and diesel engines. Such coatings have been used to delay thermally-induced failure mechanisms that can impact the durability and life of such high temperature engine components. Plasma spraying (e.g., DC-arc) techniques have been used to deposit such thermal barrier coatings (i.e., TBCs). This process involves melting a feedstock material in a plasma plume and rapidly transporting the resulting molten particles so as to "splat" against a substrate surface. The molten particles typically solidify rapidly upon contacting the substrate surface. Successive build-up of these "splat" particles has resulted in a layered arrangement of the particles in the deposited coating, where the splats are entwined in complex arrays that generally have a brick-wall-like structure. These splats are separated by inter-lamellar pores resulting from rapid solidification of the lamellae, globular pores formed by incomplete inter-splat contact or around un-melted particles, and intra-splat cracks due to thermal stresses and tensile quenching stress relaxation. These pores and cracks interfere with the direct flow of heat (thermal barrier) resulting in lowered thermal conductivity. The cracks also increase the overall compliance of the coating and enhance the thermal shock resistance.

The present invention is an improvement in methods used to apply such coatings and in the resulting coatings themselves.

SUMMARY OF THE INVENTION

Coatings applied according to the present invention are able to impart at least one functional characteristic to components or portions of an engine (e.g., a turbine or diesel engine) that are exposed to high temperatures. Such functional characteristics can include one or more or a combination of the following: (a) thermo-physical properties (e.g., thermal conductivity), (b) mechanical properties (e.g., hardness, elastic modulus, etc.), (c) abradability (e.g., a porous abradable structure at the top surface and dense structure providing adhesion near the substrate-coating interface), (d) vibration damping, (e) crack arresting, and (f) stress relaxation. These coatings can be applied so as to exhibit a gradient or other change in the functional characteristic(s) imparted (e.g., its ability to dampen vibration) through a portion or all of the thickness of the coating, across a portion or all of the surface area of the coating, or both. Such changes in the functional characteristic(s) (e.g., vibration damping ability) imparted to the coating can be obtained by forming the coating with a corresponding gradient or other change in the particle interfaces between the deposited particles forming the coating. In this way, coatings can be applied according to the present invention so as to protect and increase the useful life expectancy of high temperature components such as, for example, turbine blades, turbine vanes or other parts of a turbine engine.

In one aspect of the present invention, a method is provided for imparting at least one or more of a variety of functional characteristic (e.g., those listed above) to one or more components or portions of an engine (e.g., a turbine or diesel engine). The method comprises providing at least a portion of an engine and at least two or more (i.e., a plurality of) particle feedstocks that are different from each other. At least one of the particle feedstocks includes particles that are different from another of the particle feedstocks. For example, the different particle feedstocks can comprise different particle materials (e.g., ceramic material, metallic material or a combination thereof, compositions, structures (e.g., solid or hollow particles), sizes (e.g., fine or coarse particles), or a combination thereof. The method further comprises spraying or otherwise depositing (e.g., using a thermal spraying process to deposit) particles from each of the different particle feedstocks so as to form a high temperature resistant coating on at least a part or all of a surface of the engine portion. The particle deposition process comprises a step of depositing (e.g., spraying) particles, and each of the different particle feedstocks is used as a source of particle material during the particle deposition step (i.e., the particle feedstock is varied in-situ while the particles are being deposited). In addition, at least one functional characteristic corresponds to, or results from, using the different particle feedstocks during the particle deposition step.

The high temperature resistant coating formed by the present method can be a multi-functional coating that imparts at least two functional characteristics to the portion of the engine. The two functional characteristics can correspond to, or results from, using the different particle feedstocks during the particle deposition step.

The high temperature resistant coating formed by the present method can also comprise particles that are partially bonded together, with corresponding particle interfaces. In addition, the use of different particle feedstocks during the particle deposition step can cause the resulting coating to have a change in the particle interfaces through the thickness of the coating, across the surface area of the coating or both. Such a change in the particle interfaces can result in the coating exhibiting a corresponding change in the ability of the coating to impart at least one functional characteristic to the engine portion through a portion or all of the thickness of the coating, across a portion or all of the surface area of the coating or both. The change in the particle interfaces of the high temperature resistant coating can be in the form of, or at least include, a graded pore structure (i.e., graded porosity) through a portion or all of the thickness of the coating.

The high temperature resistant coating formed by the present method can be a multi-functional coating that imparts at least two functional characteristics to the portion of the engine. These two functional characteristics can correspond to, or result from, the change in the particle interfaces through a portion or all of the thickness of the coating, across a portion or all of the surface area of the coating or both. The high temperature resistant coating can also comprise multiple layers. For example, the coating can include a layer closer to the engine surface with relatively more porosity and particle interfaces, and another layer located further from the engine surface with relatively less porosity and fewer particle interfaces.

The present method can be used to form a thermal barrier coating, a high temperature resistant bond coat, or both. Typically, a bond coat is first applied directly to (i.e., so as to contact) the surface of the engine portion, before a thermal barrier coating is applied. In accordance with the present invention, it may be possible to apply the thermal barrier directly to the surface of the engine portion, without using an intermediate bond coat.

The present method can further comprise providing a particle deposition device (e.g., a conventional plasma spray gun) and at least two or more (i.e., a plurality of) powder feeders connected to a particle feedstock delivery port mounted on the particle deposition device. In this way, each of the different particle feedstocks can be delivered to the particle feedstock delivery port through a different one of the powder feeders.

In another aspect of the present invention, a portion of an engine is provided that is made according to a method comprising the above described method. The high temperature coating can be a continuous coating, as defined herein.

In an additional aspect of the present invention, an engine component is provided that comprises a surface that is at least partially coated with a high temperature continuous coating. The continuous coating imparts at least one functional characteristic to the engine component.

DETAILED DESCRIPTION

Figure 1:
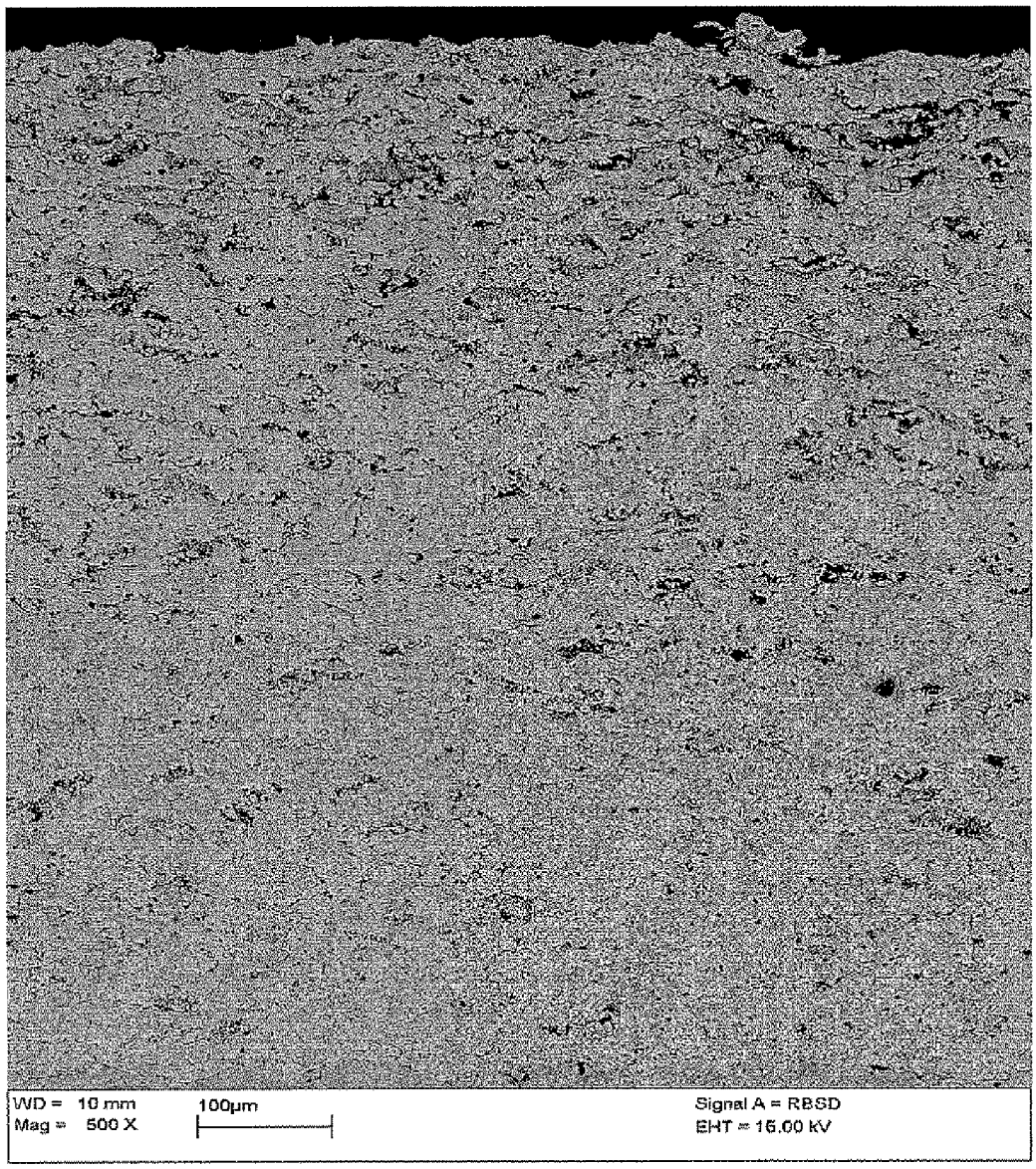
FIG. 1 is an SEM photomicrograph of the cross-section of a high temperature resistant coating according to the present invention, with a porosity gradient in one direction.

The present inventive method can be used to impart one or more of a variety of functional characteristics to one or more components or portions of, for example, a turbine or diesel engine that may be exposed to high temperatures (e.g., ring segments, transition ducts, combustors, blades, vanes and shrouds of a turbine engine or portions thereof. While the particle deposition process is proceeding, each of the different particle feedstocks are used as a source of particle material for the deposited coating. By using the different particle feedstocks, the resulting high temperature resistant coating has a difference in its thickness, in its surface area or both that imparts one or more functional characteristics to at least the coated portion of the engine.

It is understood that various particle deposition techniques may by used in practicing the present inventive method so as to form a high temperature resistant coating on at least a part or all of a surface of the engine portion. For example, processes that may be used to deposit particles from different particle feedstocks include plasma spray coating (e.g., DC-arc plasma spray, low pressure plasma spraying, solution plasma spraying, mini plasma spraying, and wire-arc spraying), combustion spray coating, high velocity oxygen-fuel (HVOF) thermal spraying, and any other thermal spraying process.

The particle feedstocks used according to the present method can be made to be different by using particles that are different from one another in any number of ways. For example, the different particle feedstocks can comprise particles made from different ceramic material, metallic material (i.e., elemental or alloyed metals or metal compounds) or a combination thereof. In addition, the particles can have different compositions, structures (e.g., solid or hollow particles) or sizes (e.g., fine or coarse particles). Any combination of these particle differences could also be used.

The functional characteristics imparted according to the present invention can include one or more or a combination of the following: (a) thermo-physical properties (e.g., thermal conductivity), (b) mechanical properties (e.g., hardness, elastic modulus, etc.), (c) abradability (e.g., a porous abradable structure at the top surface and dense structure providing adhesion near the substrate-coating interface), (d) vibration damping, (e) crack arresting, and (f) stress relaxation. These coatings can be applied so as to exhibit a gradient or other change in the functional characteristic(s) imparted (e.g., its ability to dampen vibration) through a portion or all of the thickness of the coating, across a portion or all of the surface area of the coating, or both. Such changes in the functional characteristic(s) (e.g., vibration damping ability) imparted to the coating can be obtained by forming the coating with a corresponding gradient or other change in the particle interfaces between the deposited particles forming the coating.

The high temperature resistant coating formed by the present method can also comprise particles that are partially bonded together, with corresponding particle interfaces. In addition, the use of different particle feedstocks during the particle deposition step can cause the resulting coating to have a change in the particle interfaces through the thickness of the coating, across the surface area of the coating or both. Such a change in the particle interfaces can result in the coating exhibiting a corresponding change in the ability of the coating to impart at least one functional characteristic to the engine portion through a portion or all of the thickness of the coating, across a portion or all of the surface area of the coating or both. The change in the particle interfaces of the high temperature resistant coating can be in the form of, or at least include, a graded pore structure (i.e., graded porosity) through a portion or all of the thickness of the coating.

The high temperature resistant coating formed by the present method can be a multi-functional coating that imparts at least two functional characteristics to the portion of the engine. These two functional characteristics can correspond to, or result from, the change in the particle interfaces through a portion or all of the thickness of the coating, across a portion or all of the surface area of the coating or both. The high temperature resistant coating can also comprise multiple layers. For example, the coating can include a layer closer to the engine surface with relatively more porosity and particle interfaces, and another layer located further from the engine surface with relatively less porosity and fewer particle interfaces.

The present method can be used to form a thermal barrier coating, a high temperature resistant bond coat, or both. Typically, a bond coat is first applied directly to (i.e., so as to contact) the surface of the engine portion, before a thermal barrier coating is applied. In accordance with the present invention, it may be possible to apply the thermal barrier directly to the surface of the engine portion, without using an intermediate bond coat.

As used herein, a "continuous coating" is a coating that is formed using a continuous particle deposition process, where the coating continues to be deposited while the particle material (i.e., particle feedstock) being deposited is varied. With a continuous coating, individual layers of the feedstock material are not readily discernable in the coating. That is, no distinct interface is observable between adjoining layers, even at high magnifications of up to about 1000×.

As used herein, the term "particle" refers to a solid, porous or hollow particle that is any size, shape and/or otherwise configured so as to be suitable for forming the desired coating, including but limited to flattened (i.e., splat particles) or otherwise deformed particles.

As used herein, two particles are considered fused together when a surface of one particle is at least partially melt bonded or otherwise diffusion bonded to a surface of the other particle in whole or, typically, in part.

As used herein, a "splat particle" is a particle that has impacted a surface and flattened so as to be thinner than it is wide. For example only, a splat particle can be plate-like or flake-like. A splat particle can also have a uniform or non-uniform thickness.

As used herein, a "particle interface" refers to the boundary or interface between contacting, opposing or otherwise adjacent surfaces of neighbor particles. For example only, a particle interface can be any space or gap between neighboring particles, any area of contact between neighboring particles, and any region of fusion between neighboring particles. Neighboring particles are particles that do not have another particle therebetween.

As used herein, a "splat interface" is a type of particle interface between neighboring splat particles such as the interfaces, e.g., made from neighboring hollow particles.

As used herein, a "particle pore interface" is a type of particle interface that is in the form of a space or gap between neighboring particles. Such particle pore interfaces can be in the form of globular pores, inter-lamellar pores and any other form of porosity. Particle pore interfaces can also be in the form of a crack. A particle pore interface can include an area between neighboring particles where the neighboring particles make partial or complete contact but are not fused together in the area(s) of contact. Particle pore interfaces defined by neighboring particles that contact each other, but are not fused together, can form mechanical bonds within the coating.

Such fused or mechanically bonded particle interfaces can function to dissipate vibration energy transmitted through the engine component or portion by absorbing the vibration energy. Such particle interfaces can absorb vibration energy, when the energy is intense enough to deform or break such bonds between the neighboring particles. For example, with a mechanically bonded particle pore interface, the frictional forces between the neighboring particles will need to be overcome, at least in part, in order to absorb vibration energy. By using the vibration energy to overcome or at least stretch the neighboring particle bonds, the transmission of vibration through the coated engine component or portion can be likewise halted or diminished.

As the number of particle interfaces in a given volume of coating increases, the ability of that volume of coating to dampen vibration can also increase, especially as the number of particle pore interfaces increases. The number of particle interfaces for a given volume of coating can increase as the number of particles increases (e.g., as the size of the particles decreases), as the thickness of the deposited particles decreases or both. In addition, as the number and/or size of particle pore interfaces or other porosity increases for a given volume of coating, the ability of that volume of coating to dampen vibration can also increase. The elastic modulus of a given volume of coating can be inversely affected by the number and/or size of particle pore interfaces, or other porosity, as well as by the number of other particle interfaces in the given volume of coating. For example, the elastic modulus of a given volume of coating material typically decreases as number of particle interfaces in the volume of coating increases. Therefore, since the number, type and/or size of particle interfaces can indicate the ability of the coating to dampen vibration, measured values of the elastic modulus of a given volume (e.g., one or more coating layers, one or more coating surface areas) of coating material can be used to characterize the vibration damping ability of the entire coating material. For example, as the elastic modulus of a given volume of coating material changes one way, the vibration damping ability of that volume of coating material may change the opposite way.

The use of in-situ particle feedstock variation during thermal spraying, to impart one or more functional characteristics to an engine portion being coated, can be accomplished using a conventional plasma particle spray gun by connecting a number of powder feeders to the particle feedstock delivery port of the spray gun. For example, when two different particle feedstocks are used, a Y-shaped tubular connector can be employed, with each of the powder feeders being connected to one of the upper tubular arms of the Y-shaped connector. The lower tubular leg of the Y-shaped connector is then directly connected, or through an intermediate hose or tube, to the particle feedstock delivery port mounted on the spray gun. Preferably, each powder feeder supplies only one of the different particle feedstocks to the particle spray gun. When more than two different particle feedstocks are used, a tubular connector having a corresponding number of upper tubular arms, and one lower tubular leg, can be employed to connect the appropriate number of powder feeders to the particle feedstock delivery port of the plasma particle spray gun. In this way, each of the different particle feedstocks can be delivered to the particle feedstock delivery port through a different one of the powder feeders. With the appropriate number of powder feeders and their corresponding particle feedstocks connected to the spray gun, the particle feedstocks can be varied while the spray gun is being operated by activating and deactivating the powder feeders in a sequence intended to produce changes in (e.g., the microstructure and/or composition) of the deposited coating that will impart the desired functional characteristics to the engine portion being coated. In this way, the different particle feedstocks can be optimized with regard to their feed rates and the spraying process conditions used in order to produce the microstructure desired for each coating.

Referring to FIG. 1, a coating according to one embodiment of the present invention exhibits a forward grading of porosity that changes from about 3% porosity near the surface of the substrate being coated (i.e., at the bottom of the photomicrograph) to about 30% at the top surface of the coating (i.e., at the top of the photomicrograph). The coating of FIG. 1 was produced using five different particle feedstocks deposited sequentially one after the other, without stopping the operation of the spray gun or varying the parameters of the thermal spraying process. Each feedstock comprised 7 weight percent yttria stabilized zirconia (7YSZ) powder. Each of the five feedstocks was deposited so as to form a layer having an average thickness of about 200 mm. The first layer, nearest the surface of the substrate, was formed using a feedstock of 100% fine particles. The next or second layer was formed using a feedstock of 75% fine particles and 25% coarse particles. The next or third layer was formed using a feedstock of 50% fine particles and 50% coarse particles. The next or fourth layer was formed using a feedstock of 25% fine particles and 75% coarse particles. The last or fifth layer, at the top of the coating, was formed using a feedstock of 100% coarse particles. A graded coating results that has a denser structure with micro-cracks near the substrate leading to a porous microstructure at the top surface of the coating. The micro-cracks are caused by thermally induced strain resulting from the use of plasma spray processing. This coating structure can be highly desirable for metallic bond coat applications, where the bond coat has to be dense near the substrate surface to control its oxidation behavior and rough at its top surface to promote good adhesion with the thermal barrier coatings. The dense bond coat portion near the substrate surface also provides good corrosion resistance. For the case of ceramic thermal barrier coatings, this graded coating, i.e., dense near the substrate and porous at its top surface, can help provide adhesion to the bond coat surface and abradability at the top surface of the coating.

Figure 2:
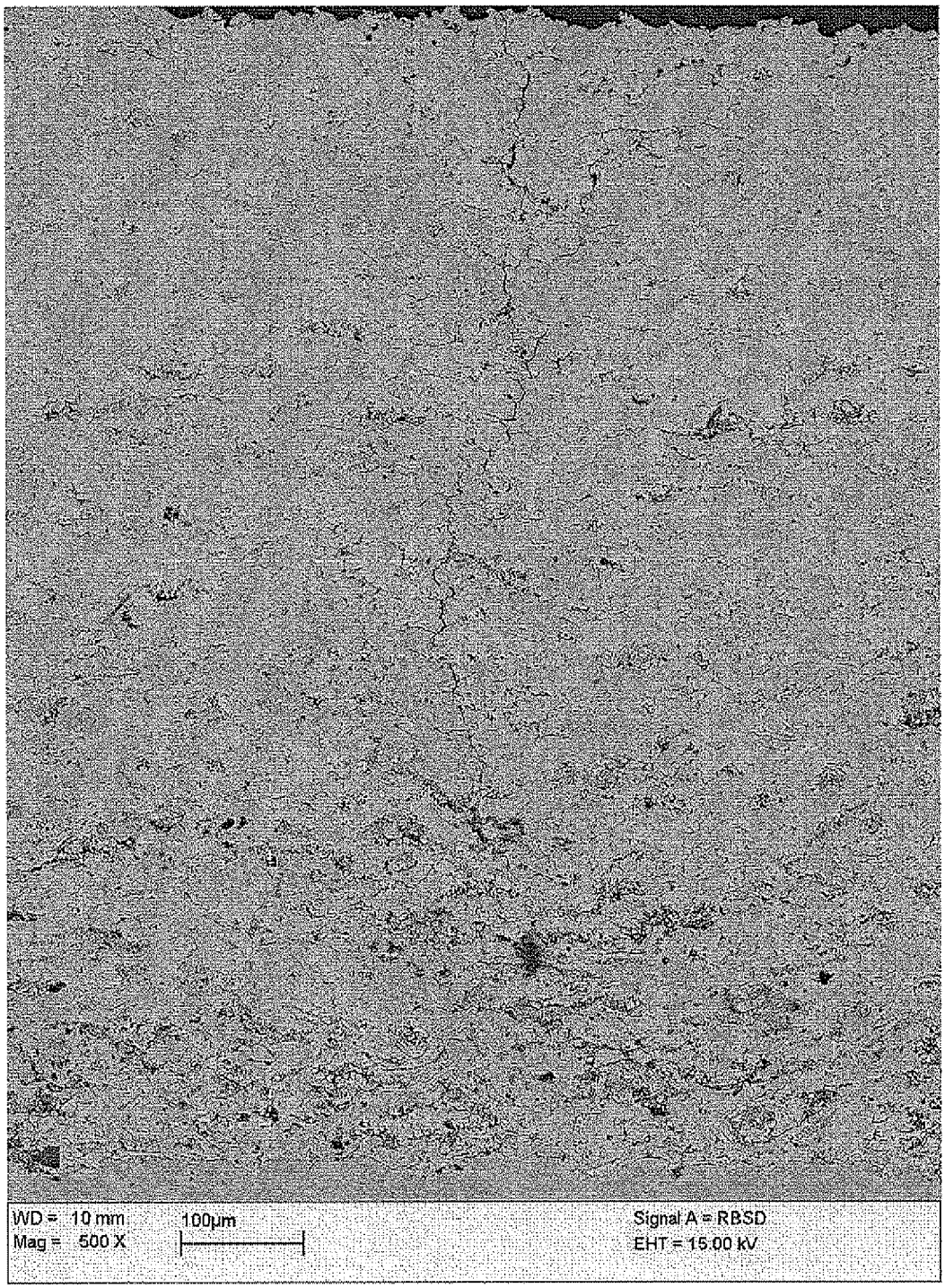
FIG. 2 is an SEM photomicrograph of the cross-section of a high temperature resistant coating according to the present invention, with a porosity gradient in a direction opposite to that of the coating in FIG. 1.

Referring to FIG. 2, a coating according to another embodiment of the present invention exhibits a reverse gradient of porosity, compared to FIG. 1, that changes from about 30% porosity near the surface of the substrate being coated (i.e., at the bottom of the photomicrograph) to about 3% at the top surface of the coating (i.e., at the top of the photomicrograph). The coating of FIG. 2 was produced using a procedure and particle feedstocks similar to that for the coating of FIG. 1, except that the order of the particle feedstocks was reversed. That is, the first layer, nearest the surface of the substrate, was formed using a feedstock of 100% coarse particles, the second layer was formed using a feedstock of 25% fine particles and 75% coarse particles, the third layer was formed using a feedstock of 50% fine particles and 50% coarse particles, the fourth layer was formed using a feedstock of 75% fine particles and 25% coarse particles, and the fifth layer, at the top of the coating, was formed using a feedstock of 100% fine particles. Each feedstock used in this example comprised 7 weight percent yttria stabilized zirconia (7YSZ) powder. A graded coating results that has a porous microstructure near the substrate leading to a denser structure with cracks at the top surface of the coating. The cracks generated at the top surface of the coating can include micro-cracks but are typically macro-cracks. Micro-cracks developed in the denser coating layer near the substrate of the FIG. 1 coating, because the substrate acted as a heat sink to reduce the degree of thermally induced strain in that layer. In the FIG. 2 coating, macro-cracks developed in the denser coating layer, because that layer is deposited on and in contact with an intermediate layer that is not as good of a heat sink as the substrate. Thus, the top layer of the coating can get to higher temperatures, which can result in a higher degree of thermal strain and cause larger cracks to form. This coating structure can be highly desirable for thermal barrier coating applications, where the porous microstructure near the substrate acts as a crack arrestor, thermal barrier and stress relaxer and the dense structure along with the macro-crack structure at the top of the coating provides strain tolerance, thermal shock and erosion resistance properties.

As used herein, the term "fine" refers to particles having an average diameter of about 35 microns, and the term "coarse" refers to particles having an average diameter of about 75 microns. For the coatings of both FIG. 1 and FIG. 2, because the layers were deposited continuously, no distinct interface can be observed between adjacent layers, even at magnifications as high as about 100×.

In one example of the type of graded coating shown in FIG. 2, the resulting microstructure changes from a porous layer near the bottom of the coating (i.e., near the surface of the substrate) to a dense and vertically cracked layer at the top surface of the coating, with a corresponding elastic modulus that varied from about 19 GPa near the surface of the substrate to about 40 GPa at the top surface of the coating. This variation in modulus/structure can result in a variation of the mechanism of damping from layer to layer.

Graded coatings can also be produced by using different particle feedstocks with a non-continuous particle deposition process, such as the processes described in the commonly assigned, concurrently filed U.S. Provisional Application Ser. No. 60/973,563 and commonly assigned patent application, U.S. Ser. No. 12/019,931, entitled ENGINE PORTIONS WITH FUNCTIONAL CERAMIC COATINGS AND METHODS OF MAKING SAME, filed concurrently herewith, the entire disclosure of each of these applications is incorporated by reference herein.

What is claimed is:

1. A method of imparting at least one functional characteristic to a portion of an engine, said method comprising:

providing at least a portion of an engine comprising a surface;

providing different particle feedstocks, with at least one of the particle feedstocks comprising particles that are different from another of the particle feedstocks; and depositing particles from each of the different particle feedstocks so as to form a high temperature resistant coating on at least part of the surface of the engine portion, with the high temperature resistant coating having a thickness and a surface area, the high temperature resistant coating comprising (a) a plurality of particles that are partially bonded together and (b) corresponding particle interfaces;

wherein:

depositing particles from each of the different particle feedstocks comprises depositing the particles, each of the different particle feedstocks being used as a source of particle material during the depositing, and-at least one functional characteristic corresponds to using the different particle feedstocks during the depositing;

the different particle feedstocks used during the depositing results in the coating having a change in the particle interfaces through the thickness of the coating, across the surface area of the coating or both;

the coating exhibits a corresponding change in the ability of the coating to impart at least one functional characteristic to the engine portion through the thickness of the coating; and the change in the particle interfaces of the coating includes a graded pore structure through the thickness of the coating.

2. The method according to claim 1, wherein the different particle feedstocks comprise different particle materials, compositions, structures, sizes, or a combination thereof.

3. The method according to claim 1, wherein the at least one functional characteristic is from the following group of functional characteristics: (a) thermo-physical properties, (b) mechanical properties, (c) abradability, (d) vibration damping, (e) crack arresting, and (f) stress relaxation.

4. The method according to claim 1, wherein the high temperature resistant coating formed by said method is a multi-functional coating that imparts at least two functional characteristics to the portion of the engine, and the two functional characteristics correspond to using the different particle feedstocks during the step of said depositing.

5. The method according to claim 1, wherein the high temperature resistant coating formed by said method is a multi-functional coating that imparts at least two functional characteristics to the portion of the engine, and the two functional characteristics correspond to the change in the particle interfaces through the thickness of the coating, across the surface area of the coating or both.

6. The method according to claim 1, wherein the high temperature resistant coating comprises multiple layers, with a layer closer to the engine surface having relatively more porosity and particle interfaces, and with another layer located further from the engine surface having relatively less porosity and fewer particle interfaces.

7. The method according to claim 1, wherein said depositing forms a thermal barrier coating, a high temperature bond coat, or both.

8. The method according to claim 1 further comprising:

providing a particle deposition device and a plurality of powder feeders connected to a particle feedstock delivery port mounted on the particle deposition device, wherein each of the different particle feedstocks is delivered to the particle feedstock delivery port through a different one of the powder feeders.

9. A method of imparting at least one functional characteristic to a portion of an engine, said method comprising:

providing at least a portion of an engine comprising a surface;

providing different particle feedstocks, with at least one of the particle feedstocks comprising particles that are different from another of the particle feedstocks; and depositing particles from each of the different particle feedstocks so as to form a high temperature resistant coating on at least part of the surface of the engine portion, with the high temperature resistant coating having a thickness and a surface area, the high temperature resistant coating comprises (a) a plurality of the particles that are partially bonded together and (b) corresponding particle interfaces;

wherein:

depositing particles from each of the different particle feedstocks comprises depositing the particles, each of the different particle feedstocks being used as a source of particle material during the depositing, and at least one functional characteristic corresponds to using the different particle feedstocks during the depositing;

the different particle feedstocks used during the depositing results in the coating having a change in the particle interfaces through the thickness of the coating, across the surface area of the coating or both;

the coating exhibits a corresponding change in the ability of the coating to impart at least one functional characteristic to the engine portion through the thickness of the coating, across the surface area of the coating or both; and the high temperature resistant coating comprises multiple layers, with a layer closer to the engine surface having relatively more porosity and particle interfaces, and with another layer located further from the engine surface having relatively less porosity and fewer particle interfaces.

10. The method according to claim 9, wherein the different particle feedstocks comprise different particle materials, compositions, structures, sizes, or a combination thereof.

11. The method according to claim 9, wherein the at least one functional characteristic is from the following group of functional characteristics: (a) thermo-physical properties, (b) mechanical properties, (c) abradability, (d) vibration damping, (e) crack arresting, and (f) stress relaxation.

12. The method according to claim 9, wherein the high temperature resistant coating formed by said method is a multi-functional coating that imparts at least two functional characteristics to the portion of the engine, and the two functional characteristics correspond to using the different particle feedstocks during the step of said depositing.

13. The method according to claim 9, wherein the high temperature resistant coating formed by said method is a multi-functional coating that imparts at least two functional characteristics to the portion of the engine, and the two functional characteristics correspond to the change in the particle interfaces through the thickness of the coating, across the surface area of the coating or both.

14. The method according to claim 9, wherein said depositing forms a thermal barrier coating, a high temperature bond coat, or both.

15. The method according to claim 9, further comprising:

providing a particle deposition device and a plurality of powder feeders connected to a particle feedstock delivery port mounted on the particle deposition device, wherein each of the different particle feedstocks is delivered to the particle feedstock delivery port through a different one of the powder feeders.

16. A method of imparting at least one functional characteristic to a portion of an engine, said method comprising:

providing at least a portion of an engine comprising a surface;

providing different particle feedstocks, with at least one of the particle feedstocks comprising particles that are different from another of the particle feedstocks;

providing a particle deposition device and a plurality of powder feeders connected to a particle feedstock delivery port mounted on the particle deposition device; and depositing particles via the particle deposition device from each of the different particle feedstocks so as to form a high temperature resistant coating on at least part of the surface of the engine portion, with the high temperature resistant coating having a thickness and a surface area, wherein each of the different particle feedstocks is used as a source of particle material during the depositing, at least one functional characteristic corresponds to using the different particle feedstocks during the depositing, and each of the different particle feedstocks is delivered to the particle feedstock delivery port through a different one of the powder feeders.

17. The method according to claim 16, wherein the different particle feedstocks comprise different particle materials, compositions, structures, sizes, or a combination thereof.

18. The method according to claim 16, wherein the at least one functional characteristic is from the following group of functional characteristics: (a) thermo-physical properties, (b) mechanical properties, (c) abradability, (d) vibration damping, (e) crack arresting, and (f) stress relaxation.

19. The method according to claim 16, wherein the high temperature resistant coating formed by said method is a multi-functional coating that imparts at least two functional characteristics to the portion of the engine, and the two functional characteristics correspond to using the different particle feedstocks during the step of said depositing.

20. The method according to claim 16, wherein the high temperature resistant coating comprises (a) a plurality of the particles that are partially bonded together and (b) corresponding particle interfaces, the different particle feedstocks used during the step of said depositing results in the coating having a change in the particle interfaces through the thickness of the coating, across the surface area of the coating or both, and the coating exhibits a corresponding change in the ability of the coating to impart at least one functional characteristic to the engine portion through the thickness of the coating, across the surface area of the coating or both.

* * * * *